US006416310B1

(12) United States Patent
Son

(10) Patent No.: US 6,416,310 B1
(45) Date of Patent: Jul. 9, 2002

(54) SHAPING APPARATUS FOR FORMING PATTERN ON SURFACE OF CIVIL ENGINEERING STRUCTURE USING CONCRETE

(76) Inventor: Cheul Ju Son, 147-6, Geum-Dong, Dong-Gu, Gwangju (KR)

( * ) Notice: Subject to any disclaimer, the term of this patent is extended or adjusted under 35 U.S.C. 154(b) by 12 days.

(21) Appl. No.: 09/748,933

(22) Filed: Dec. 27, 2000

(30) Foreign Application Priority Data

Dec. 27, 1999 (KR) ..... 99-62742

(51) Int. Cl.[7] ..... E01C 19/26

(52) U.S. Cl. ..... 425/363; 425/385; 425/471; 404/93; 404/124

(58) Field of Search ..... 425/471, 472, 425/363, 373, 385; 404/75, 93, 124

(56) References Cited

U.S. PATENT DOCUMENTS 519,919 A * 5/1894 Maurer
1,887,341 A * 11/1932 Venable
3,910,711 A * 10/1975 Moorhead
5,421,670 A * 6/1995 Meirick
6,024,511 A * 2/2000 Ross

* cited by examiner

*Primary Examiner*—Robert Davis
*Assistant Examiner*—Donald Heckenberg
(74) *Attorney, Agent, or Firm*—Klauber & Jackson

(57) ABSTRACT

Disclosed is a shaping apparatus for forming a pattern on the surface of a civil engineering structure using concrete, in order to provide a shaping beauty on the surface of the civil engineering structure using concrete or asphalt concrete, for example, on the surface of a sidewalk or a retaining wall constructed for pedestrians in general streets or parks or on the surface of a concrete structure for a finishing process of other kinds of civil engineering construction. The shaping apparatus includes: a pair of frames of a plate shape each installed in parallel on the left and right sides; a driving force generating unit installed on any of the pair of frames; a pair of forward and backward idle rolls installed horizontally on the upper and lower sides of the front and rear portions of the pair of frames; a pair of forward and backward driving rolls connected to the driving force generating unit as any of them serves to a power transmission member; a track type of band mold installed for winding the pair of forward and backward idle rolls and the pair of forward and backward driving rolls to thereby run the shaping apparatus in a rolling-moving manner and having relief and intaglio patterns on the external surface thereof.

9 Claims, 6 Drawing Sheets

SHAPING APPARATUS FOR FORMING PATTERN ON SURFACE OF CIVIL ENGINEERING STRUCTURE USING CONCRETE

BACKGROUND OF THE INVENTION

1. Field of the Invention

The present invention relates to a shaping apparatus for forming relief or intaglio patterns of various shapes on the surface of a civil engineering structure, in order to provide a shaping beauty on the surface of the civil engineering structure using concrete or asphalt concrete, for example, on the surface of a sidewalk or a retaining wall constructed for pedestrians in general streets or parks or on the surface of a concrete structure for a finishing process of other kinds of civil engineering construction, and more particularly, to a shaping apparatus for forming a pattern on the surface of a civil engineering structure using concrete that is capable of forming a predetermined pattern in continuous and repetitive manners on the surface of the civil engineering structure, while a track type of mold is rolling and moving.

2. Description of the Related Art

Generally, various kinds of methods, which form patterns on the surface of a civil engineering structure using concrete, for example, on the surface of a sidewalk or a retaining wall constructed for pedestrians in general streets or parks or on the surface of a concrete structure for a finishing process of other kinds of civil engineering construction, have been developed and are now commercialized. Representative examples of the methods are a casting method and a stepping method.

In case of the casting method using a mold, a cement mortar is filled in the mold installed according to a civil engineering structure and after curing for a predetermined time, the mold is shaped into a predetermined shape, thereby forming a desired pattern on the surface of a concrete structure. However, the casting method has experienced the following problems: it is not easy to install and remove the mold; the installation and removal cost of the mold and the manufacturing cost thereof are all expensive; a plurality of different molds should be prepared in order to form different kinds of patterns, which is not economical; and the working efficiency is considerably reduced.

On the other hand, in case of the stepping method, using a mold of a plate shape on which a unit pattern having a size capable of carrying out a forming process by the hands of an operator is formed in relief and intaglio, the operator forms the pattern manually in a tamping manner. However, the stepping method has experienced the following problems: the pattern shape is differently molded based upon the pressing force of the operator; the pattern shapes are also not uniform, which causes the appearance of the concrete structure to be degraded; and the working efficiency is considerably reduced.

SUMMARY OF THE INVENTION

It is, therefore, an object of the present invention to provide a shaping apparatus for forming a pattern on the surface of a civil engineering structure using concrete, which is capable of forming the pattern in a series of continuous processes, while a track type of mold is rolling and moving, thereby forming a uniform pattern and improving working efficiency.

It is another object of the present invention to provide a shaping apparatus for forming a pattern on the surface of a civil engineering structure using concrete, which is capable of selectively folding the both sides of a mold in accordance with the configuration or obstacle of the ground on a construction site, thereby achieving an excellent constructing efficiency.

To attain these and other objects of the present invention, there is provided a shaping apparatus for forming a pattern on the surface of a civil engineering structure using concrete, which comprises: a pair of frames of a plate shape each installed in parallel on the left and right sides; a driving force generating unit installed on any of the pair of frames; a pair of forward and backward idle rolls installed horizontally on the upper and lower sides of the front and rear portions of the pair of frames; a pair of forward and backward driving rolls connected to the driving force generating unit as any of them serves to a power transmission member; a track type of band mold installed for winding the pair of forward and backward idle rolls and the pair of forward and backward driving rolls to thereby run the shaping apparatus in a rolling-moving manner and having relief and intaglio patterns on the external surface thereof; and a plurality of sets of tamping units installed in such a manner that at least one or more tamping units traverse the pair of frames and driven by a plurality of operating cams installed on a rotary shaft that is connected by means of the power transmission member to the driving force generating unit, for intermittently tamping a pattern-formed section of the band mold, wherein the track type of band mold rolls and moves on the concrete surface that is not yet cured to thereby form a desired pattern on the concrete surface in a series of continuous processes.

DETAILED DESCRIPTION OF THE PREFERRED EMBODIMENTS

Figure 1:
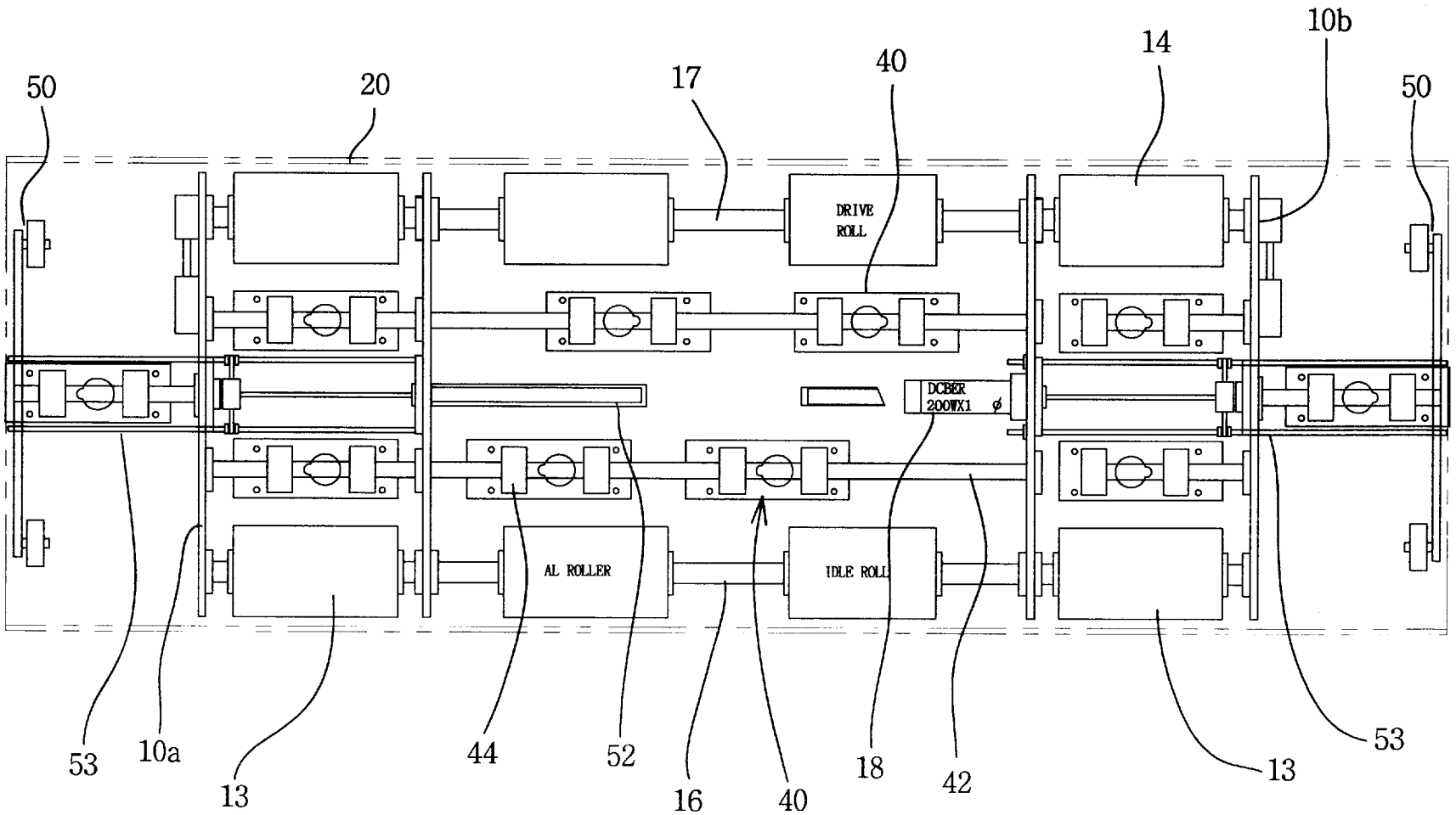
FIG. 1 is a schematic plan view illustrating the configuration of a shaping apparatus for forming a pattern on the surface of a civil engineering structure using concrete according to an embodiment of the present invention.
Figure 2:
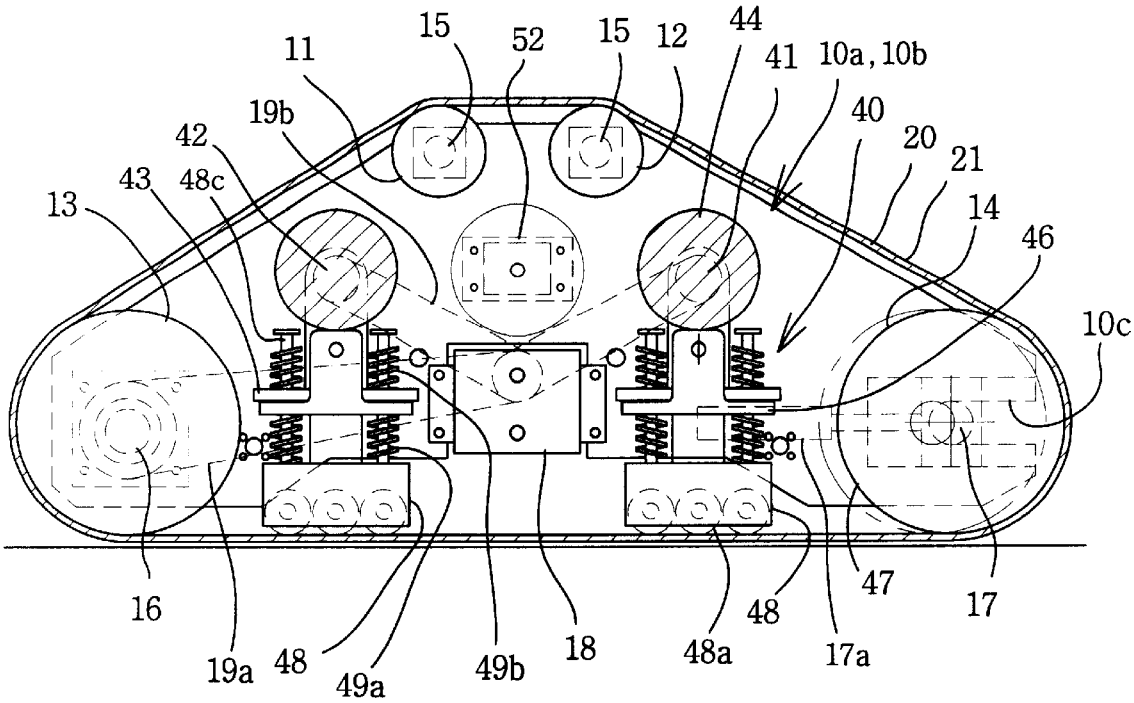
FIG. 2 is a side sectional view of FIG. 1.
Figure 3:
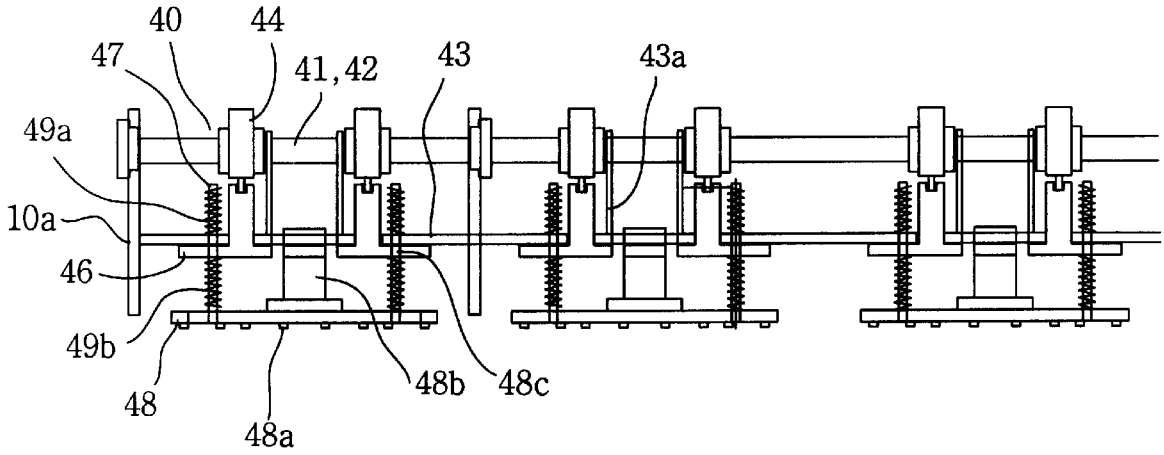
FIG. 3 is a partial exemplary view illustrating the tamping unit in FIG. 1.

Now, an explanation of a shaping apparatus for forming a pattern on the surface of a civil engineering structure using concrete according to preferred embodiments of the present invention will be discussed with reference to the accompanying drawings. FIG. 1 is a schematic plan view illustrating the configuration of a shaping apparatus for forming a pattern on the surface of a civil engineering structure using concrete according to an embodiment of the present invention, and FIG. 2 is a side sectional view of FIG. 1.

A principal characteristic of the present invention is a track type mold that rolls and moves on the surface of a concrete structure in a series of continuous processes, thereby forming a desired pattern thereon in a stepping manner.

The shaping apparatus of the present invention includes a pair of frame units 10*a* and 10*b* of a plate shape vertically in parallel on the left and right sides and a pair of forward and backward idle rolls 11 and 12 and a pair of forward and backward driving rolls 13 and 14 each installed horizontally on the upper and lower sides of the front and rear portions of the pair of frames 10*a* and 10*b*. The pair of forward and backward idle rolls 11 and 12 are freely rotatable on an idle shaft 15 which is installed horizontally to pass through the pair of frames 10*a* and 10*b*, and the pair of forward and backward driving rolls 13 and 14 are installed on driving and driven shafts 16 and 17 that are installed horizontally to pass through the pair of frames 10*a* and 10*b* on the lower portion of the idle shaft 15 and rotate by the reception of a driving force from a driving force generating unit 18 as will be discussed below at a first power transmission member 19*a*. In this case, the driven shaft 17 is freely movable to the inner and outer sides of the frames 10*a* and 10*b* along a guide rail 10*c* provided on the rear end sides of the pair of frames 10*a* and 10*b* by the driving force of a first actuator 17*a*, such that the distance between the driving shaft 16 and the driven shaft 17 can be varied, which allows the exchange work of a band mold 20 as will be discussed later to be carried out in a simple manner.

Further, the shaping apparatus of the present invention includes the track type of band mold 20 that is installed to wind the pair of forward and backward idle rolls 11 and 12 and the pair of forward and backward driving rolls 13 and 14, at the external direction thereof, while they are being disposed in the inward direction thereof. The band mold 20 is made of a rubber material having somewhat hardness or other synthetic resin. And, the band mold 20 has a pattern forming surface 21 composed of relief and intaglio patterns on the external surface thereof. Hence, the track type of band mold 20 moves by the driving force transmitted through the driving shaft 16 to the forward driving roll 13 and completes the pattern forming process. That is, the band mold 20 rolls and moves on the surface of the concrete structure that is not cured, thereby forming a predetermined pattern thereon through the pattern forming surface 21 provided thereon.

In order to form various kinds of patterns on the surface of the concrete structure, the band mold 20 of the present invention can be prepared by patterns and exchanged into one having other patterns, if necessary.

Also, the shaping apparatus of the present invention includes a plurality of sets of tamping units 40. The tamping units 40 are installed on the upper sides of the pair of frame units 10*a* and 10*b* and between the idle shaft 15 and the driving and driven shafts 16 and 17 and driven by respective operating cams 44 installed on each of a pair of driven shafts 41 and 42 that are connected via a second power transmission member 19*b* to the driving force generating unit 18 and driven. In more detail, each of the tamping units 40 includes a first pressurizing plate 46 that passes through a plate 43 installed by means of a set of hanging bar 13*a* on the idle shaft 15 and is ascended by the contact-movement on the operating cam 44 and a second pressurizing plate 48 that is ascended and guided by a pair of guide pins 48*c* installed to pass through the first pressurizing plate 46 and the plate 43, on the direct lower portion of the first pressurizing plate 46. Each of the guide pins 48*c* of each tamping unit 40 has a first spring 49*b* for restoring the second pressurizing plate 48 on the upper side of the plate 43 and a second spring 49*a* for indirectly transmitting the pressurizing force of the first pressurizing plate 46 to the second pressurizing plate 48, on a portion between the first and second pressurizing plates 46 and 48.

On the other hand, the second pressurizing plate 48 is provided with a plurality of rolling rolls 48*a* for smooth sliding contact with the band mold 20 on the bottom surface thereof.

The tamping units 40 as constructed above are installed in a width direction of the band mold 20 in a small unit, thereby conducting an intermittent tamping operation.

Each of the tamping units 40 further has a vibrator 48*b* that is installed on the second pressurizing plate 48, for applying vibration on the second pressurizing plate 48 upon the temping operation of the second pressurizing plate 48.

On each of the external upper sides of the pair of frames 10*a* and 10*b*, an auxiliary idle roll 50 extends from each frame and supports the both sides of the band mold 20. The auxiliary idle rolls 50 are moved and guided along a guide bar 53 that passes through the pair of frames 10*a* and 10*b* and extends outward and appear and disappear on the outward sides of the frames 10*a* and 10*b* by means of a second actuator 52 using air, such that the both sides of the band mold 20 are partially folded upon the generation of interference due to the configuration or obstacle of the ground on a construction site during an operation.

Figure 4A:
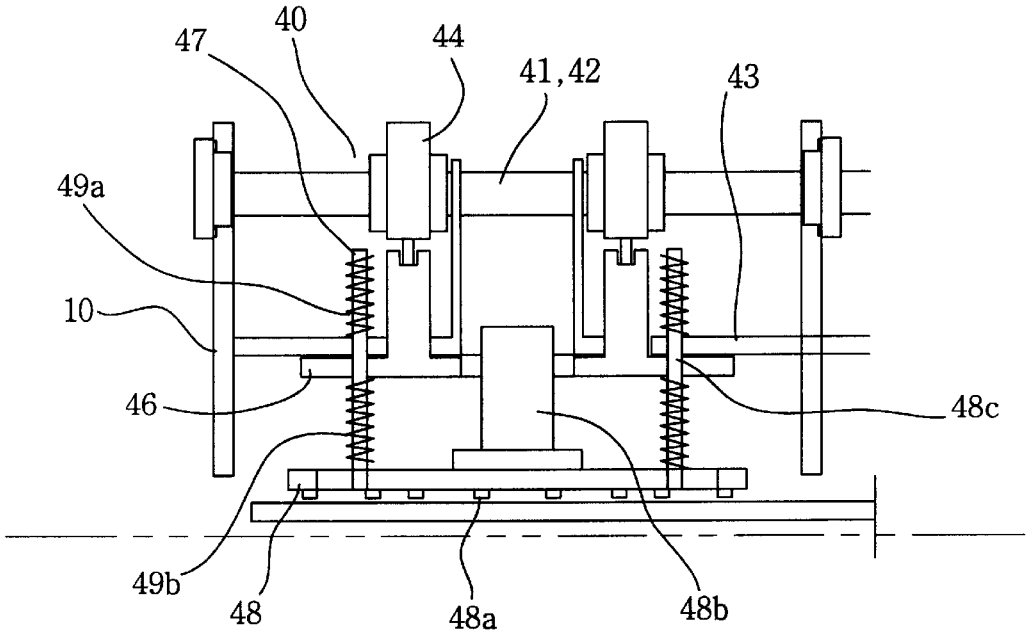
FIGS. 4*a* and 4*b* are exemplary views illustrating the operating process of the tamping unit.
Figure 4B:
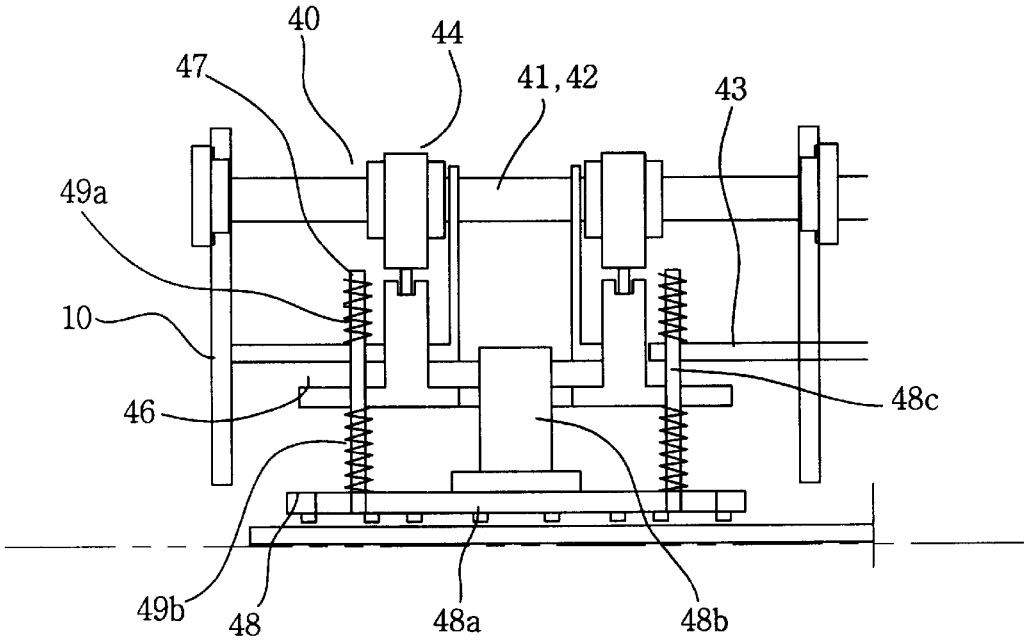

Referring to FIGS. 4*a* and 4*b*, an explanation of the operation of the shaping apparatus of the present invention will be discussed. Firstly, the shaping apparatus of the present invention is disposed on the surface of the concrete structure (which is not cured) to be constructed. In this state, if the driving force generating unit 18 operates, the driving force therefrom is transmitted to the driving shaft 16 through the first power transmission member 19*a*, thereby rotating the forward driving roll 13. The driving force transmitted to the forward driving roll 13 results in the rotation of the band mold 20, thereby rolling and moving the shaping apparatus. As a result, the pattern forming surface 21 of the band mold 20 forms a desired pattern on the surface of the concrete structure in a series of continuous processes. At this time, each of the tamping units 40 intermittently applies a pressurizing force by means of the eccentric operating cam 44, thereby enhancing a quality of the pattern formed. Moreover, the pattern formed on the surface of the concrete structure can be clear and vivid by means of the vibrator 48*b* provided on the second pressurizing plate 48 of each of the tamping units 40.

In case where interference is caused due to the configuration and obstacle of the ground on a construction site during an operation, the auxiliary idle rolls 50 are folded and thus, the both sides of the band mold 20 are partially lifted, such that the interference can be avoided without any difficulties, thereby achieving the pattern forming process in a continuous manner.

Figure 5:
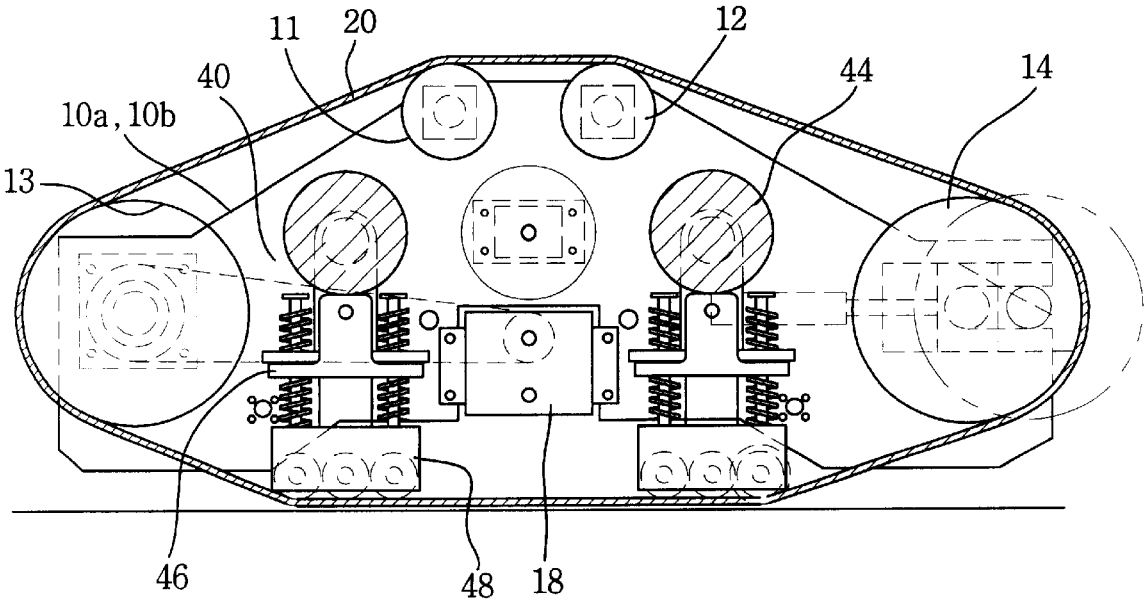
FIG. 5 is a side sectional view illustrating the configuration of a shaping apparatus for forming a pattern on the surface of a civil engineering structure using concrete according to another embodiment of the present invention.

FIG. 5 shows the shaping apparatus according to another embodiment of the present invention. This embodiment shows an example where the forward and backward driving rolls 13 and 14 are installed, while separating from the ground. In case of forming a fine pattern, the shaping apparatus of FIG. 5 is desirable.

Figure 6:
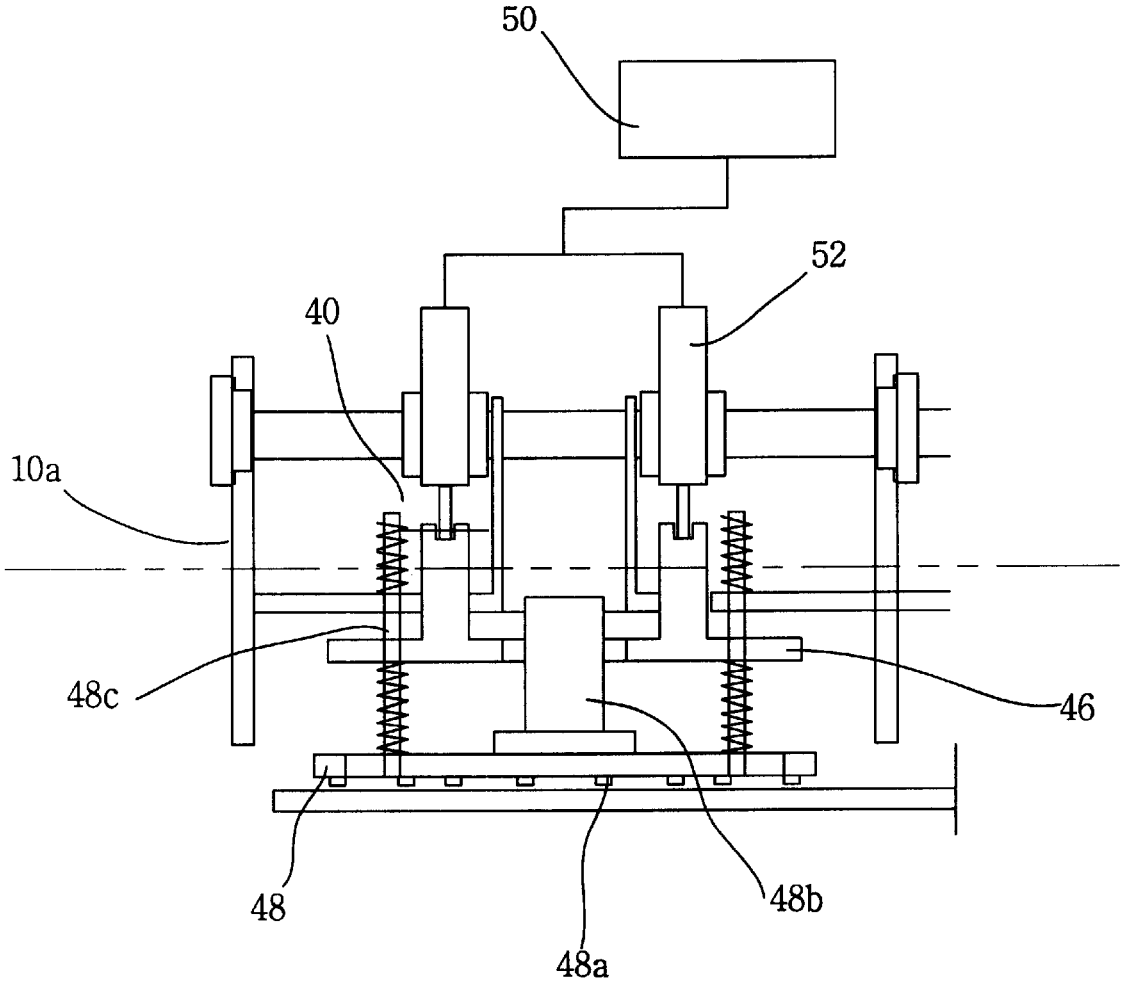
FIG. 6 is an exemplary view illustrating another embodiment of the tamping unit of the present invention.

FIG. 6 shows another example of the tamping unit 40 according to the present invention. In this case, the tamping unit 40 may be driven not by the operating cam but by a third actuator 52 that is driven by a compressed air control 50.

In the shaping apparatus of the present invention, the driving shaft 16 and the driven shaft 17 installed on the front sides of the pair of frames 10*a* and 10*b* are long shafts. The long driving and driven shafts 16 and 17 may be changed into flexible shafts using universal joint, in order to meet the shape of the ground.

As clearly discussed in the above, a shaping apparatus for forming a pattern on the surface of a concrete structure according to the present invention is capable of forming a desired pattern thereon in a simple manner by using a track type of band mold in a series of continuous and repetitive processes, whereby the work and construction efficiencies are excellent and the patterns formed are uniform and clear, thereby enhancing the appearance and shaping beauty of the structure.

Furthermore, the construction cost can be reduced, thereby providing economical gains.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A shaping apparatus for forming a pattern on the surface of a civil engineering structure using concrete, said apparatus comprising:

a pair of frames of a plate shape each installed in parallel on the left and right sides of the shaping apparatus;

a driving force generating unit installed on any of said pair of frames;

a pair of forward and backward idle rolls installed horizontally on the upper and lower sides of the front and rear portions of said pair of frames;

a pair of forward and backward driving rolls connected to said driving force generating unit as any of them serves to a power transmission member; and a track of band mold installed for winding said pair of forward and backward idle rolls and said pair of forward and backward driving rolls to thereby run said shaping apparatus in a rolling-moving manner and having relief and intaglio patterns on the external surface thereof, wherein said track of band mold rolls and moves on the concrete surface that is not yet cured to thereby form a desired pattern on the concrete surface in a series of continuous processes.

2. The shaping apparatus as claimed in claim 1, further comprising an auxiliary idle roll variably installed on each of the external upper sides of said pair of frames in such a manner as appearing and disappearing from the external side of each frame by means of a separate actuator to thereby support both sides of said band mold, whereby in case where interference is caused due to the configuration or obstacle of the ground on a construction site during a forming process, both sides of said band mold are partially folded.

3. A shaping apparatus for forming a pattern on the surface of a civil engineering structure using concrete, said apparatus comprising:

a pair of frames of a plate shape each installed in parallel on the left and right sides of the shaping apparatus;

a driving force generating unit installed on any of said pair of frames;

a pair of forward and backward idle rolls installed horizontally on the upper and lower sides of the front and rear portions of said pair of frames;

a pair of forward and backward driving rolls connected to said driving force generating unit as any of them serves to a power transmission member;

a track of band mold installed for winding said pair of forward and backward idle rolls and said pair of forward and backward driving rolls to thereby run said shaping apparatus in a rolling-moving manner and having relief and intaglio patterns on the external surface thereof; and a plurality of sets of tamping units installed in such a manner that at least one or more tamping units traverse said pair of frames and driven by a plurality of operating cams installed on a rotary shaft that is connected by means of said power transmission member to said driving force generating unit, for intermittently tamping a pattern-formed section of said band mold, wherein said track of band mold rolls and moves on the concrete surface that is not yet cured to thereby form a desired pattern on the concrete surface in a series of continuous processes.

4. The shaping apparatus as claimed in claim 3, further comprising an auxiliary idle roll variably installed on each of the external upper sides of said pair of frame units in such a manner as appearing and disappearing from the external side of each frame by means of a separate actuator to thereby support both sides of said band mold, whereby in case where interference is caused due to the configuration or obstacle of the ground on a construction site during a forming process, both sides of said band mold are partially folded.

5. The shaping apparatus as claimed in claim 3, wherein each of said tamping units is driven by an actuator using air.

6. The shaping apparatus as claimed in claim 3, wherein any of said forward and backward driving rolls is provided with an actuator that expands a shaft distance between said forward and backward driving rolls and enables installing and removing said band mold.

7. The shaping apparatus as claimed in claim 3, wherein each of said tamping units comprises a first pressurizing plate ascending by means of each of said operation cams, a second pressurizing plate freely ascendable on the lower portion of said first pressurizing plate and having a pair of guide pins passing through said first pressurizing plate, a first spring of each guide pin installed on said first pressurizing plate, for restoring said second pressurizing plate and a second spring of each guide pin installed between said first and second pressurizing plates, for buffering upon tamping of said second pressurizing plate.

8. The shaping apparatus as claimed in claim 7, wherein each of said tamping units further comprises a vibrator on said second pressurizing plate.

9. The shaping apparatus as claimed in claim 7, wherein each of said tamping units further comprises a plurality of rolling rolls on the bottom surface of said second pressurizing plate, for conducting a smooth rolling contact with said band mold.

* * * * *